US008516654B1

(12) United States Patent
McCutchen et al.

(10) Patent No.: US 8,516,654 B1
(45) Date of Patent: Aug. 27, 2013

(54) FILTER SYSTEM FOR A VACUUM CLEANER

(75) Inventors: Travis D. McCutchen, Owasso, OK (US); Clinton J. McCutchen, Tulsa, OK (US)

(73) Assignee: Pathfinder Concepts, LLC, Kankakee, IL (US)

( * ) Notice: Subject to any disclaimer, the term of this patent is extended or adjusted under 35 U.S.C. 154(b) by 427 days.

(21) Appl. No.: 12/898,531

(22) Filed: Oct. 5, 2010

Related U.S. Application Data

(60) Provisional application No. 61/248,609, filed on Oct. 5, 2009.

(51) Int. Cl.
*A47L 9/10* (2006.01)

(52) U.S. Cl.
USPC ..... 15/352; 55/302; 55/484

(58) Field of Classification Search
USPC ..... 15/352; 55/293, 302, 484
IPC ..... A47L 9/10
See application file for complete search history.

(56) References Cited

U.S. PATENT DOCUMENTS

| | | | |
|---|---|---|---|
| 1,153,751 | A | 9/1915 | Beth |
| 1,784,339 | A | 12/1930 | Clasen et al. |
| 2,576,656 | A | 11/1951 | Wallin |
| 2,980,207 | A | 4/1961 | Allen |
| 3,589,520 | A | 6/1971 | Thorne |
| 3,653,188 | A | 4/1972 | Fisher et al. |
| 3,653,190 | A | 4/1972 | Lee et al. |
| 3,735,566 | A | 5/1973 | Laliwala |
| 4,286,417 | A | 9/1981 | Shelton |
| 4,329,161 | A | 5/1982 | Osborn |
| 4,376,358 | A | 3/1983 | Shelton |
| 4,465,497 | A | 8/1984 | Howeth |
| 4,533,371 | A | 8/1985 | Nakamura |
| 4,618,352 | A | 10/1986 | Nelson |
| 5,108,473 | A | 4/1992 | Hayden, Sr. |
| 5,498,197 | A | 3/1996 | Roberts et al. |
| 5,584,748 | A | 12/1996 | Flynn et al. |
| 5,868,807 | A | 2/1999 | Luy et al. |
| 5,948,127 | A | 9/1999 | Minakawa et al. |
| 6,010,547 | A | 1/2000 | Jeong et al. |
| 6,458,178 | B1 | 10/2002 | Dietz et al. |
| 6,830,599 | B1 | 12/2004 | McCutchen |
| 7,082,640 | B2 | 8/2006 | McCutchen |
| 7,147,683 | B1 | 12/2006 | McCutchen |
| 2002/0194996 | A1 | 12/2002 | Peter et al. |
| 2003/0041729 | A1 | 3/2003 | Finigan |
| 2003/0089234 | A1 | 5/2003 | Bjarno et al. |
| 2004/0055470 | A1 | 3/2004 | Strauser et al. |
| 2008/0172996 | A1 | 7/2008 | McCutchen |
| 2009/0056294 | A1 | 3/2009 | McCutchen |

*Primary Examiner* — David Redding
(74) *Attorney, Agent, or Firm* — Faegre Baker Daniels LLP

(57) ABSTRACT

A vacuum cleaner system includes at least one air flow control valve coupled to a vacuum motor, a pressure chamber and a filter. The at least one valve is operable to couple the at least one filter to the vacuum source to provide suction therethrough when the at least one valve is in a first position, and alternately to couple the at least one filter to the pressure chamber when the at least one valve is in a second position to supply pressurized air from the pressure chamber to the at least one filter to clean the at least one filter.

16 Claims, 13 Drawing Sheets

FILTER SYSTEM FOR A VACUUM CLEANER

CROSS REFERENCE TO RELATED APPLICATION

This application claims the benefit of U.S. Provisional Application Ser. No. 61/248,609, filed on Oct. 5, 2009, which is expressly incorporated by reference.

BACKGROUND AND SUMMARY

The present disclosure relates to a filter system for a vacuum cleaner. More particularly the present disclosure relates to a vacuum filter system which uses pressurized air generated by a vacuum motor to clean the filters.

Industrial vacuum cleaners are used in many applications. One illustrative application is a vacuum cleaner for use with a floor grinder. Such floor grinders grind concrete and typically need an adequate vacuum to operate properly. The present disclosure provides a robust vacuum option designed to provide continuous suction without having to stop and clear vacuum filters. The present disclosure also provides a more robust and rugged system designed to withstand the heavy use and abuse that is typical in the concrete grinding industry. The filter system of the present disclosure may also be used with other types of vacuum cleaners such as residential central vacuums, car wash vacuums or other industrial applications.

The system and method of the present disclosure provides an efficient system and method for cleaning the vacuum filters by allowing the pressure from the blower or exhaust of a vacuum motor to be selectively forced through the filters in reverse, thereby cleaning the filters. Therefore, the filters are thoroughly cleaned. The filters do not have to be cleaned as often, therefore increasing the life of filter system components. An illustrated embodiment uses a single motor to provide both suction for the vacuum and pressure for cleaning of the filters. A rotary valve arrangement of the filter system is simple to operate, while providing longevity. Main components of the filter system are located outside of the airstream, thereby providing easy replacement of the filter components.

The filter system of the present disclosure uses an exhaust from the same vacuum motor that provides the suction to selectively force air through the filters in reverse. Therefore, the illustrated filter system uses pressure to clean the filter. Conventional filter cleaning systems either use ambient air or a separate blower to clean the filters. Using pressure to clean the filters provides a more thorough cleaning and therefore allows increased cycle time. Increasing the cycle time decreases the number of times each component must operate in a given time frame and, as a result, increases the duration of all electrical components. For example, conventional vacuum filter systems clean filters every few seconds (such as every seven seconds, for example) to reduce the likelihood of clogging.

The rotary valve arrangement of the present disclosure allows the main filter components to be located outside of the air stream. This increases the duration of all mechanical components. Other vacuum filter systems have key filter components located in the air stream and are therefore more prone to premature failure.

According to an illustrated embodiment of the present disclosure, a vacuum cleaner system includes a housing having an interior region, an inlet opening, and at least one outlet opening. The system also includes a vacuum motor having an exhaust, a pressure chamber coupled to the exhaust of the vacuum motor, and at least one filter located in the interior region of the housing in communication with the at least one outlet opening of the housing. The system further includes at least one air flow control valve. Each valve is coupled to the vacuum motor, the pressure chamber and a filter. The at least one valve is operable to couple the at least one filter to the vacuum source to provide suction therethrough when the at least one valve is in a first position, and alternately to couple the at least one filter to the pressure chamber when the at least one valve is in a second position to supply pressurized air from the pressure chamber to the at least one filter to clean the at least one filter.

Additional features of the present system and method will become apparent to those skilled in the art upon consideration of the following detailed description of illustrative embodiments exemplifying the best mode of carrying out the present system and method as presently perceived.

BRIEF DESCRIPTION OF THE DRAWINGS

The foregoing aspects and other features of this invention will become more readily appreciated and better understood by reference to the following detailed description when taken in conjunction with the accompanying drawings in which.

DETAILED DESCRIPTION OF THE DRAWINGS

Figure 1:
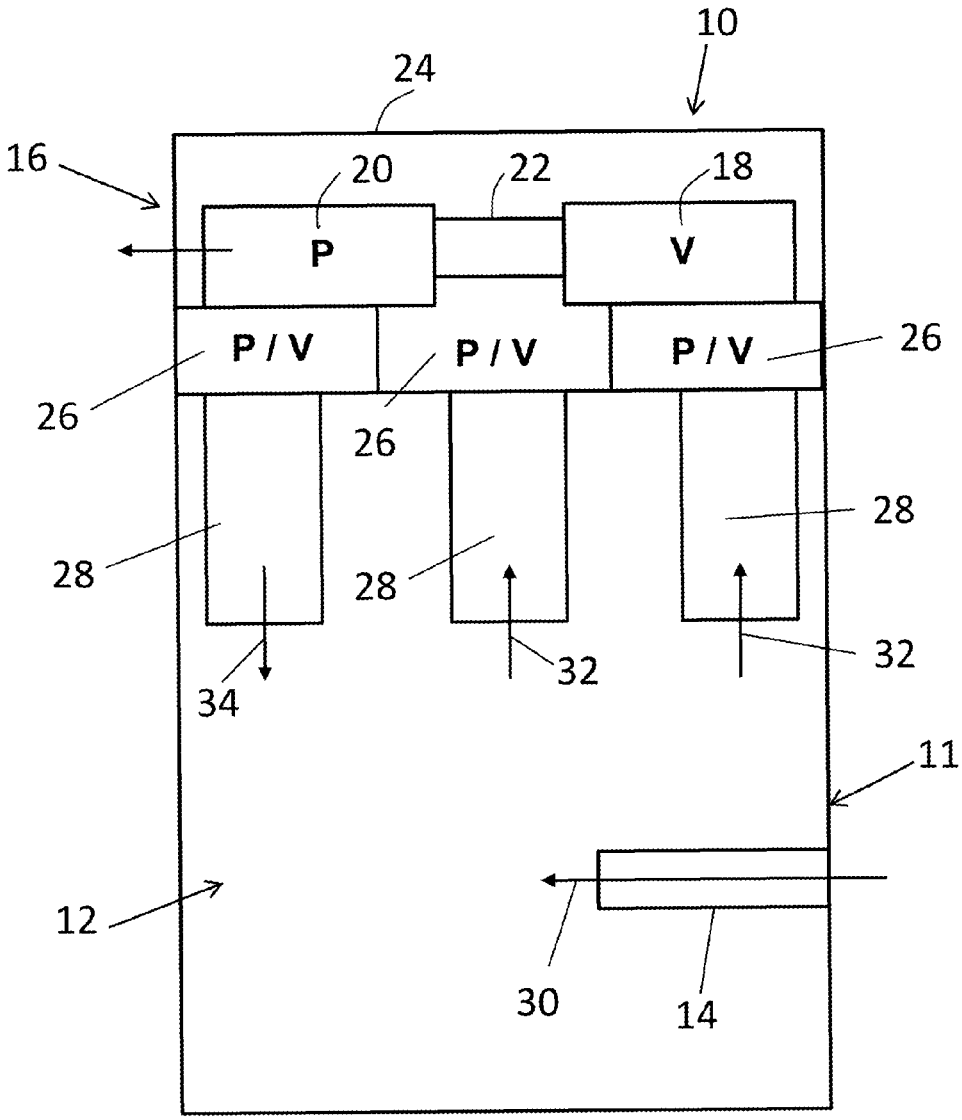
FIG. 1 is a diagrammatical view illustrating a vacuum cleaner having a filter system of the present disclosure.

For the purposes of promoting an understanding of the principles of the present disclosure, reference will now be made to the embodiments illustrated in the drawings, which are described below. The embodiments disclosed below are not intended to be exhaustive or limit the invention to the precise form disclosed in the following detailed description. Rather, the embodiments are chosen and described so that others skilled in the art may utilize their teachings. Therefore, no limitation of the scope of the claimed invention is thereby intended. The present disclosure includes any alterations and further modifications of the illustrated devices and described methods and further applications of the principles of the disclosure which would normally occur to one skilled in the art to which the invention relates. Corresponding reference characters indicate corresponding parts throughout the several views.

The present disclosure relates to a vacuum cleaner 10 diagrammatically shown in FIG. 1. Illustratively, the vacuum cleaner 10 includes a lower housing portion 11 having an interior region 12 and an inlet 14. An upper housing portion 16 includes a vacuum motor 18 and a pressure chamber 20. An outlet 22 of the vacuum motor 18 is illustratively coupled to the pressure chamber 20. Exhaust from the vacuum motor 18 creates pressure in the pressure chamber 20 as discussed below. Therefore, a separate blower is not required for the pressure chamber 20. A cover 24 is located over the vacuum motor 18 and pressure chamber 20. Control valves 26 are coupled to the vacuum source 18 and pressure chamber 20 and to filters 28 located within the interior region 12 of lower housing portion 11.

In normal operation, vacuum source 18 creates suction within the interior region 12 of lower housing portion 11 to draw air and other materials through inlet opening 14 in the direction of arrow 30. The flow control valves 26 normally permit flow of air and material through filters 28 in the direction of arrows 32. Filters 28 remove particulate matter from the air in a conventional manner.

The filters 28 may become clogged with dust or other particles entrained in the air flowing through the lower housing portion 11. In order to clear the filters 28, the flow control valves 26 are selectively actuated to cause pressurized air from pressure chamber 20 to pass through filters 28 in the direction of arrow 34, thereby removing the dust and particulate matter from the filter 28. In one embodiment, timing of the valve 26 to supply pressure from the pressure source 20 to the filter 28 is controlled electronically by a controller. Timing is based upon the type of material being vacuumed by the vacuum cleaner 10.

In another embodiment, a manually operated valve is used for the filter cleaning process. Use of manually operated valves reduces the cost of the filter system by eliminating the electronics involved in automatically powering the valves 26. In another embodiment, the flow control valves 26 are operated with a wireless remote. This embodiment is particularly useful for a single filter operation. The remote control provides more automation than a manual actuator, but still eliminates the added cost of an electronic timer.

Figure 2:
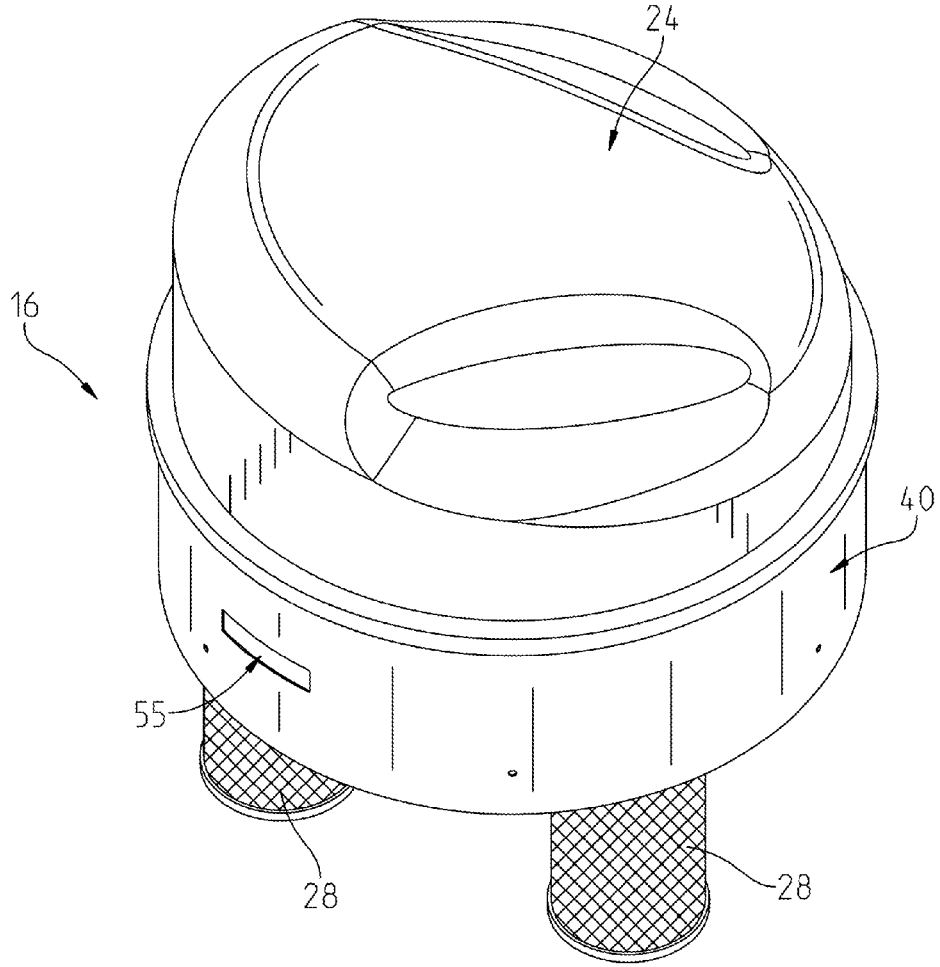
FIG. 2 is a perspective view of a removable upper housing portion of the vacuum cleaner which contains a filter system according to a first illustrated embodiment of the present disclosure.
Figure 3:
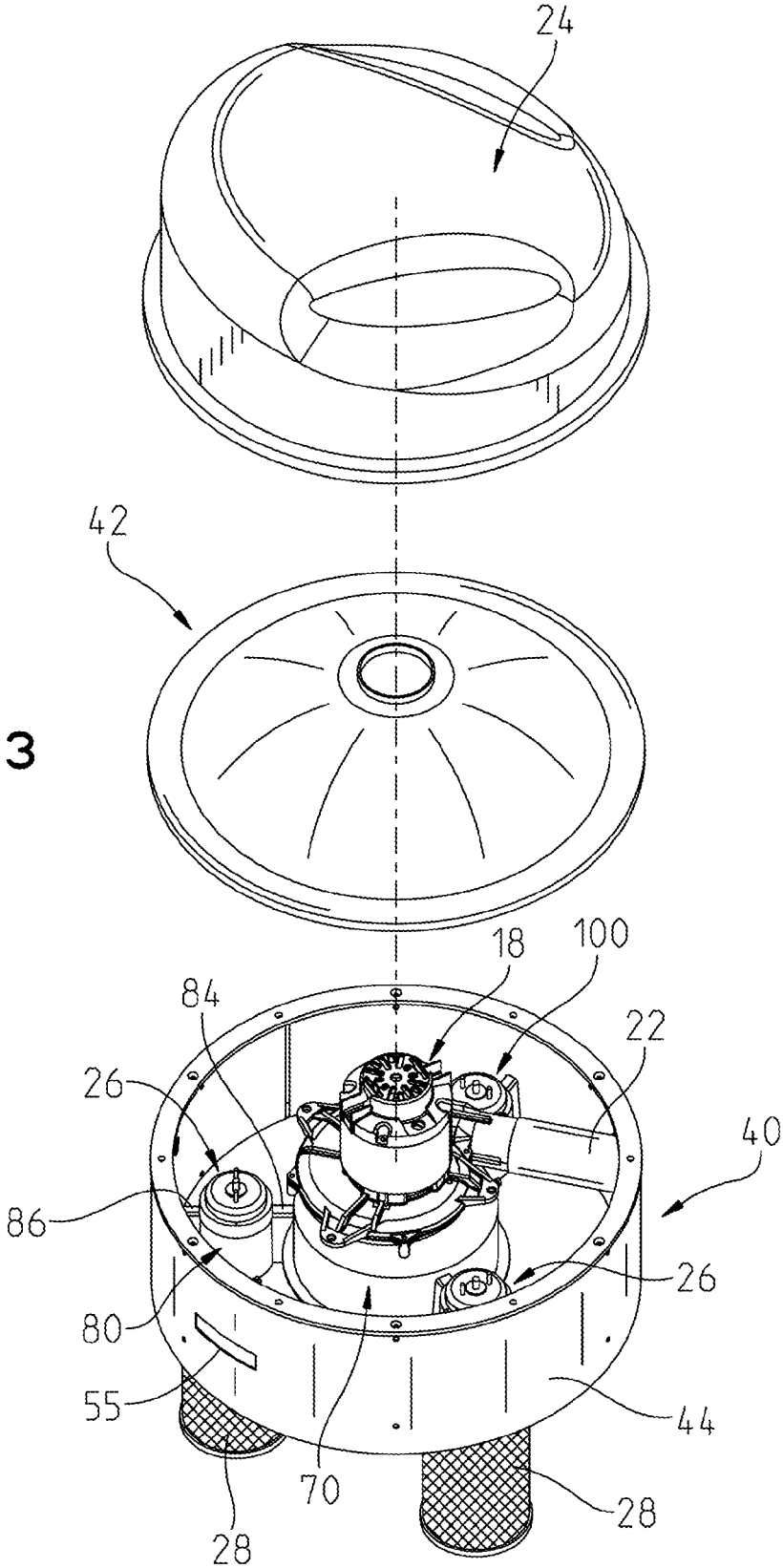
FIG. 3 is an exploded perspective view of the embodiment of FIG. 1 illustrating the filter system and a vacuum motor located inside the upper housing portion.
Figure 4:
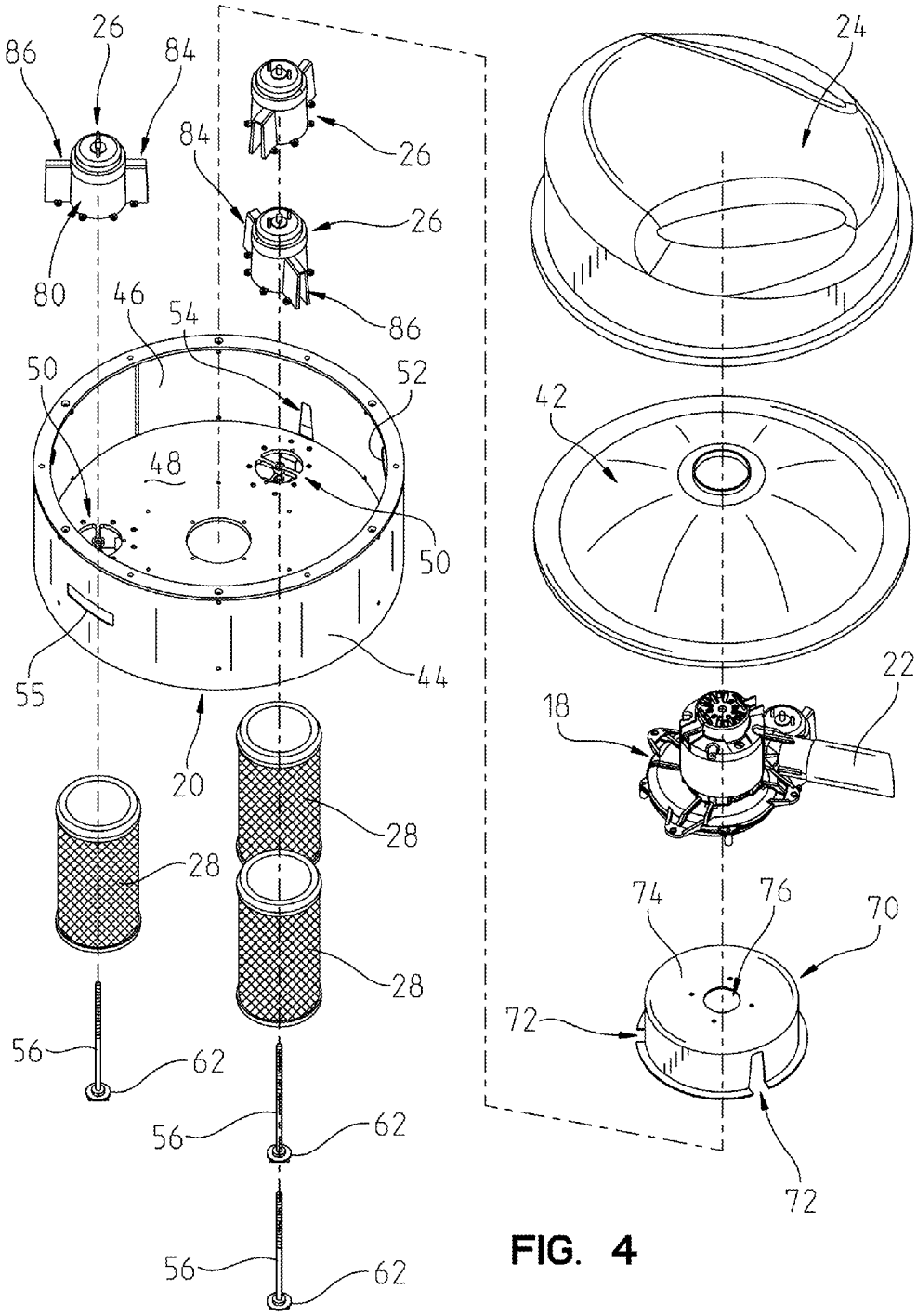
FIG. 4 is an exploded perspective view of the embodiment of FIGS. 2 and 3 illustrating further details of the filter system.

FIGS. 2-4 illustrate additional details of upper housing portion 16 containing the filter system of one embodiment of the present disclosure. Upper housing portion 16 includes a body portion 40, an inner cover plate 42 and an outer cover 24. As shown in FIG. 4, body portion 40 includes an outer wall 44 and a spaced apart inner wall 46 which define the pressure chamber 20 therebetween. Body portion 40 also includes a bottom plate 48 having apertures 50 in communication with filters 28.

Inner wall 46 of body portion 40 includes an aperture 52 coupled to the outlet 22 of the vacuum motor 18. Inner wall 46 of body portion 40 also includes apertures 54 in communication with pressure chamber 20. Outer wall 44 of the body portion 40 also includes openings 55 to allow exhaust from the vacuum motor 18 to exit the pressure chamber 20 in a controlled manner. Openings 55 are sized to optimize operation of the vacuum motor 18 while maintaining adequate pressure within the pressure chamber 20 for cleaning the filters 28. Therefore, the size and quantity of exhaust apertures 55 varies depending on the specifications of the vacuum motor 18 used.

Figure 10:
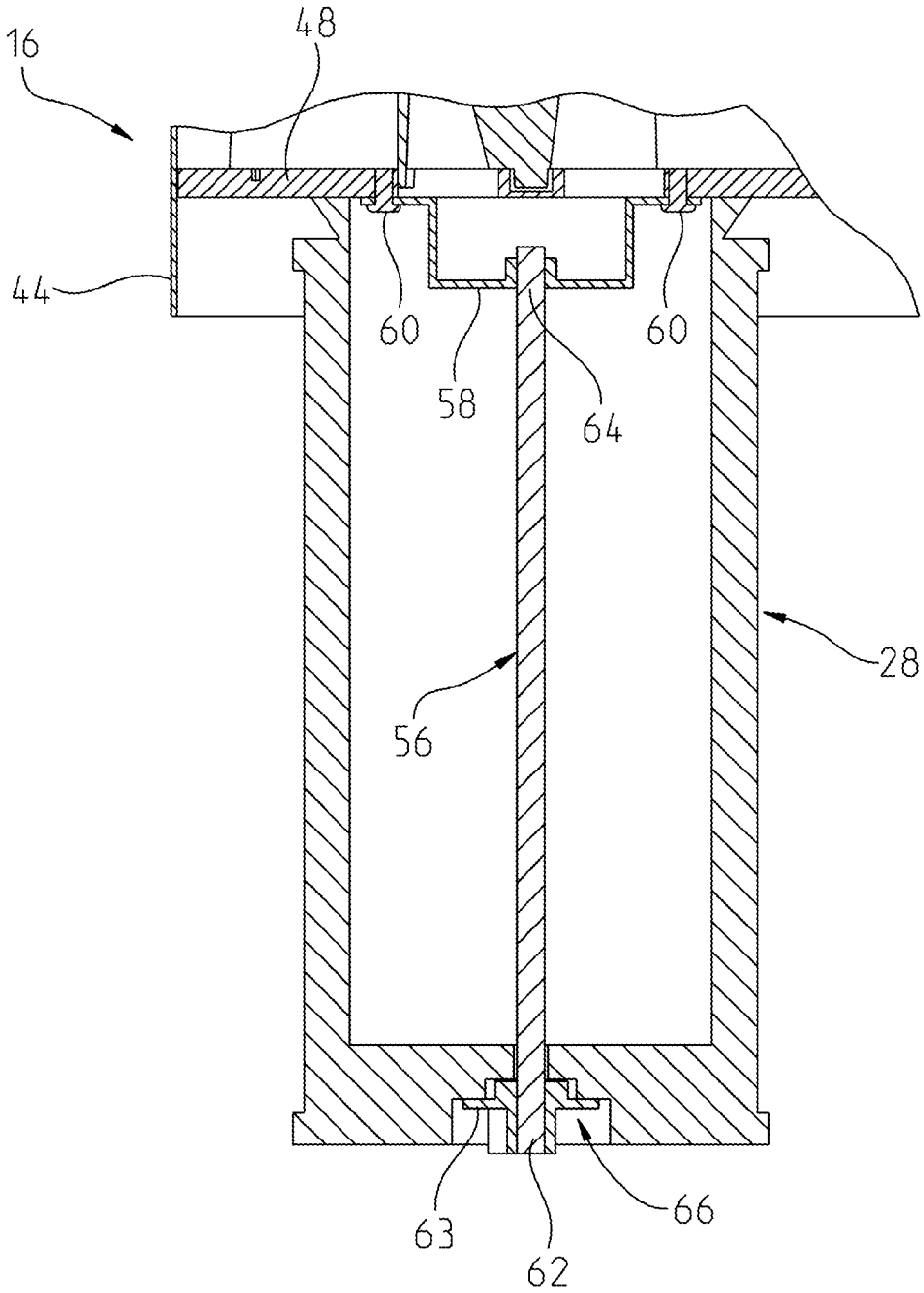
FIG. 10 is a sectional view illustrating components for mounting one of the filters to the housing of FIGS. 2-6.

Filters 28 are coupled to the bottom surface 48 of body portion 40 by connecting rods 56 as best shown in FIG. 10. A mounting bracket 58 is coupled to the bottom surface 48 by fasteners 60. The rods 56 include a wing nut 62 coupled to a first threaded end portion 62 and a second threaded end portion 64 configured to engage mating threads of mounting bracket 58. Rods 56 extend through an opening 66 of filters 28. Wing nut 62 engages a portion of the filter 28 to hold the filter 28 in place on the bottom surface 48 of body portion 40 when the threaded end 64 of rod 56 is coupled to the threaded mounting bracket 58 as shown in FIG. 10.

Referring FIGS. 3-6, a central vacuum chamber 70 is coupled to bottom surface 48 of body portion 40. Chamber 70 includes openings 72 which cooperate with the flow control valves 26 as discussed below to provide air flow to the vacuum chamber 70. Chamber 70 is coupled to bottom surface 48 with suitable fasteners so that the vacuum chamber 70 is sealed to the bottom surface 48. Vacuum motor 18 is mounted to the top surface 74 of chamber 70 by suitable fasteners so that suction is applied to the central aperture 76 of top surface 74 by vacuum motor 18.

Figure 5:
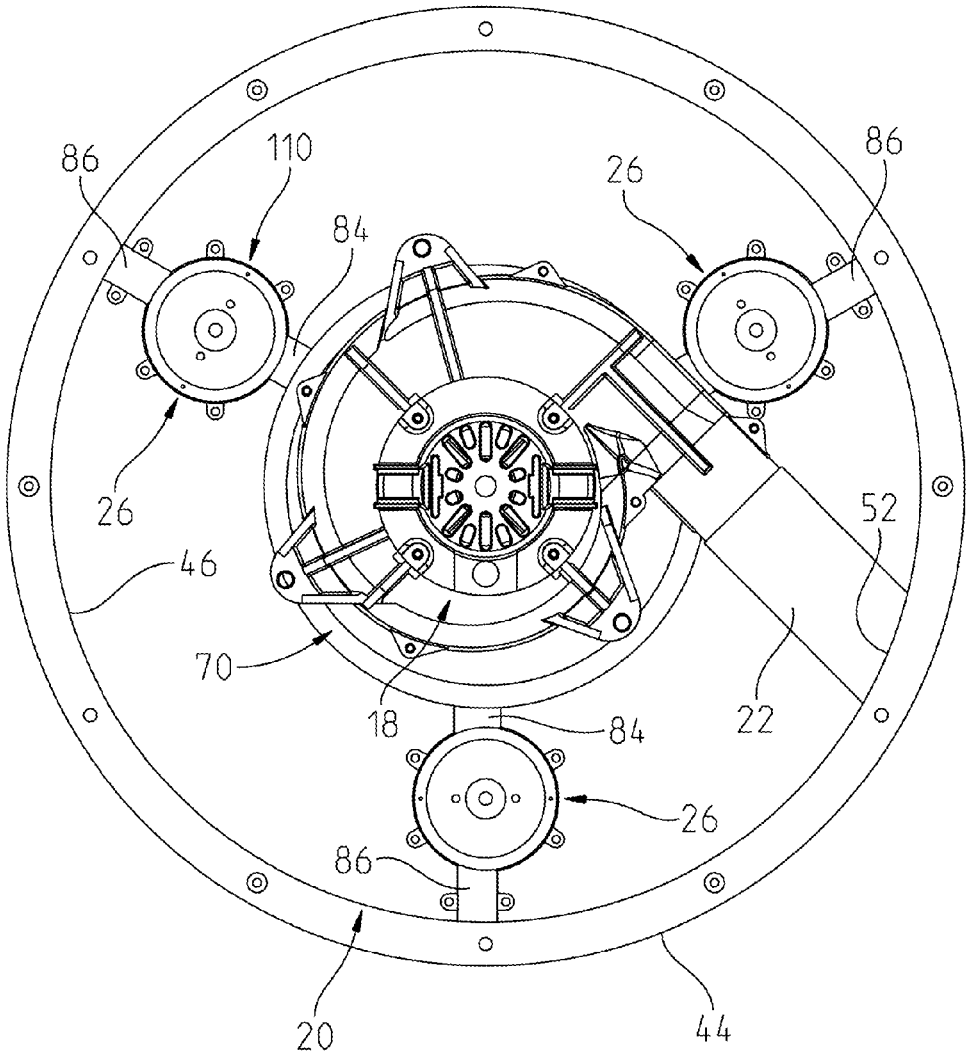
FIG. 5 is a top view illustrating the vacuum motor and filter system of FIGS. 3 and 4.

As shown in FIGS. 4 and 5, three flow control valves 26 are provided in an illustrated embodiment of the present disclosure. The arrangement of the flow control valves 26 relative to the vacuum motor 18 is best shown in FIG. 5. It is understood that one or more control valves 26 may be used in different embodiments, depending on the application. For example, one, two or three filters 28 and flow control valves 26 may be used. In each case, the vacuum motor 18 maintains the same efficiency relative to the air flow. The process works well with one filter due to the inflow of the pressurized air from the pressure chamber 20 caused by the exhaust of vacuum motor 18 as described herein. The single filter embodiment provides a very compact unit and significant cost savings which allows for entry into markets such as, for example, residential central vacuums, car wash vacuums and various other industrial applications.

Figure 6:
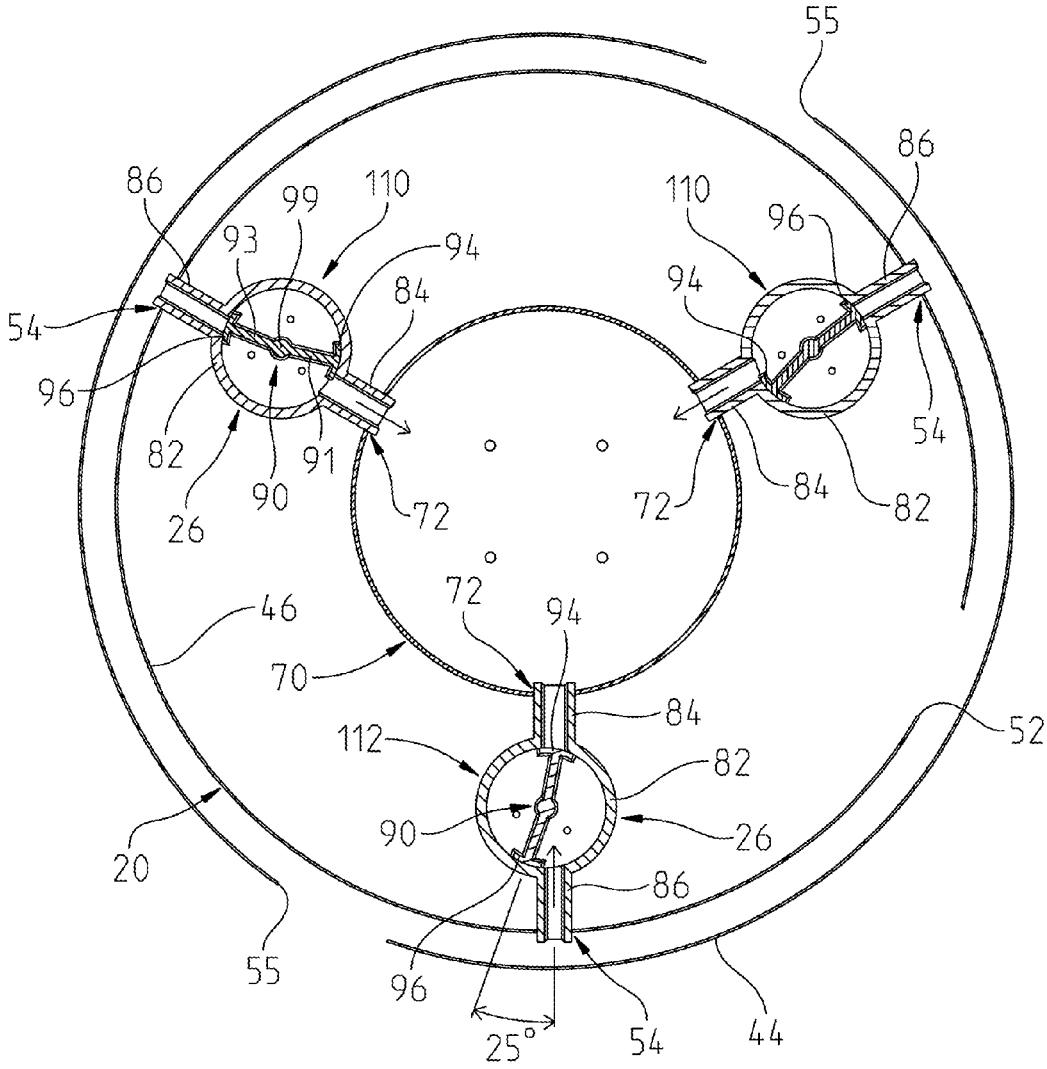
FIG. 6 is a sectional view taken through the filter system of FIG. 5 illustrating operation of a plurality of air flow control valves of the filter system.
Figure 7:
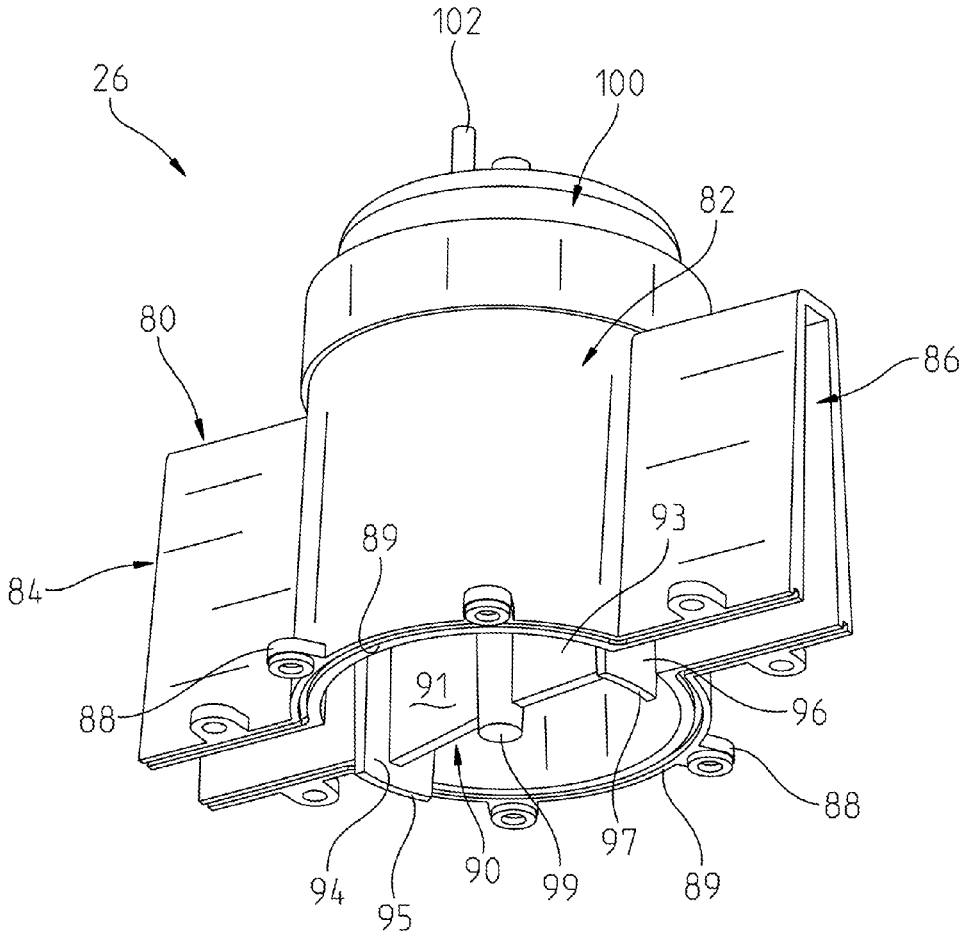
FIG. 7 is a perspective view illustrating one of the air flow control valves of the filter system of FIGS. 1-6.
Figure 8:
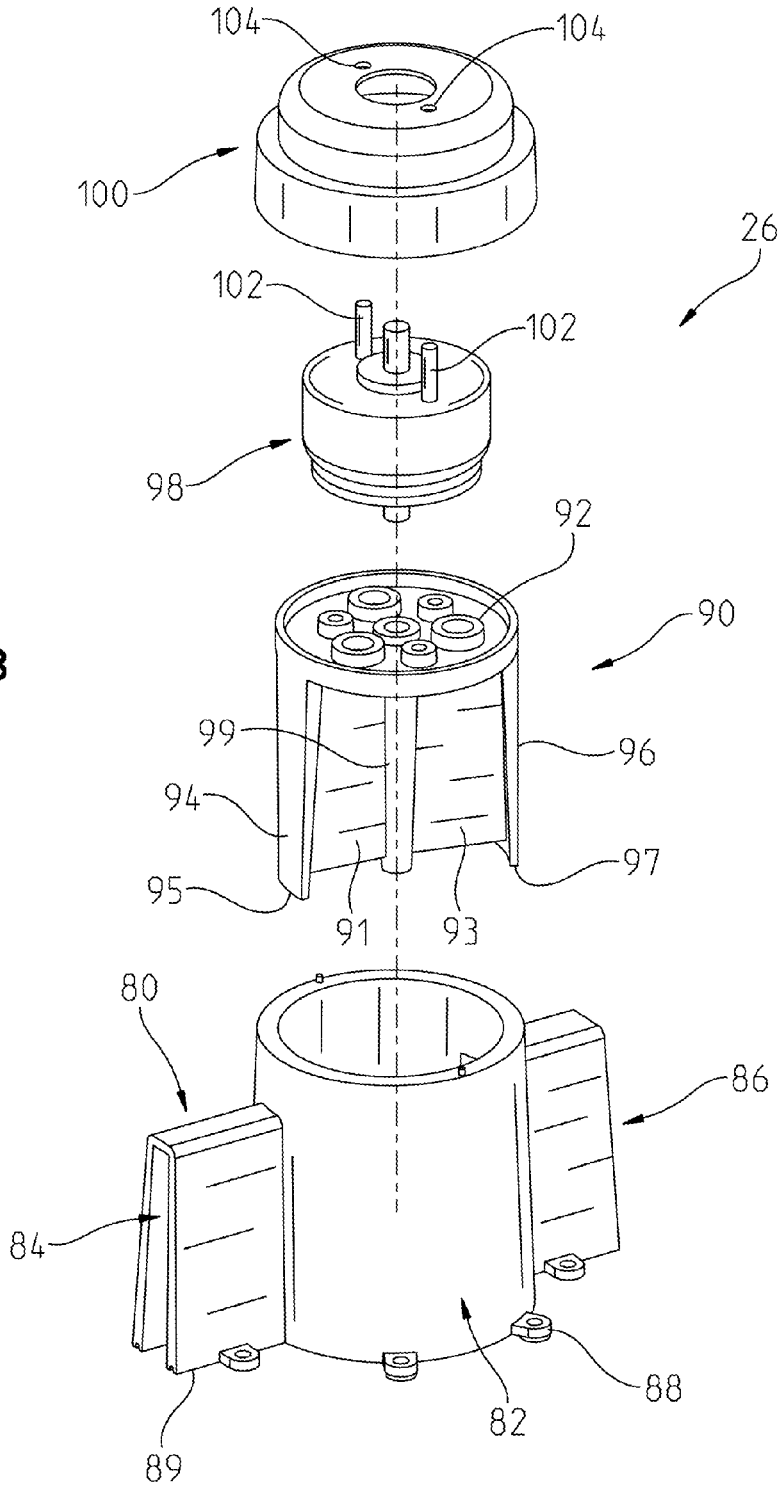
FIGS. 8 and 9 are exploded perspective views of the flow control valve of FIG. 7.
Figure 9:
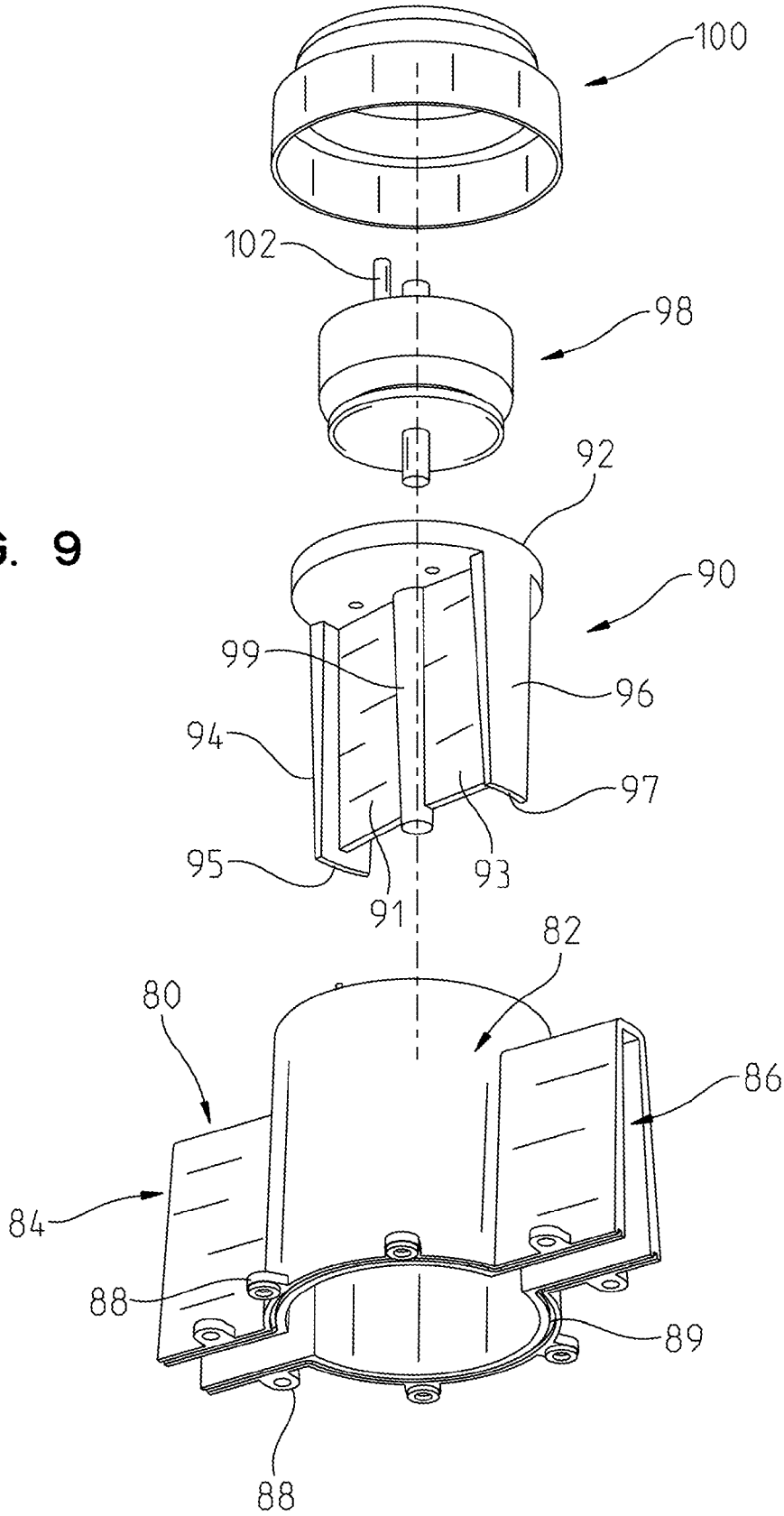

Details of the flow control valves 26 are illustrated in FIGS. 7-9. Each flow control valve 26 includes a housing 80 having a central cylindrical portion 82 and first and second passageways 84 and 86 coupled to the central cylindrical portion 82. A plurality of mounting portions 88 are located near bottom edge 89 to secure and seal the housing 80 to the bottom surface 48 of body portion 40 in the orientation shown in FIGS. 5 and 6. First passageways 84 of the valves 26 are in communication with openings 72 of inner vacuum chamber 70. Second passageways 86 of valves 26 are in communication with openings 54 of pressure chamber 20.

As best shown in FIGS. 8 and 9, each of the valves 26 includes a valve actuator paddle 90 having a top surface 92, first and second arms 91 and 93 extending away from a central hub 99, and first and second sealing surfaces 94 and 96 coupled to ends of arms 91 and 93, respectively, on opposite sides of the paddle 90. A rotary solenoid 98 is illustratively coupled to top surface 92 of actuator paddle 90. Solenoid 98 is also coupled to a cover 100 by mounting posts 102 which extend through apertures 104 of cover 100 and are secured thereto by suitable fasteners. The actuator paddle 90 is rotatable by the solenoid 98 to selectively position one of the sealing members 94 or 96 against the passageway openings 84 and 86, respectively, to control air flow through the valve 26. Bottom edge portions 95 and 97 of sealing members 94 and 96, respectively, extend below the bottom edge 89 of housing 80 and below the bottom plate 48. A bearing area is incorporated into the valve actuator paddle 90 and integrated with the bottom plate 48 to maintain concentricity. This arrangement compensates for vertical movement of the solenoid 98 during opening and closing of the valve and maintains proper sealing despite the vertical movement.

The valve actuator paddle 90 and cylindrical portion 82 of housing have internal draft angles that permit the solenoid 98 to clear itself as it rotates during operation and moves vertically relative to the housing 80. The angles taper from larger to smaller on the actuator paddle 90 toward the filter end and smaller toward the bottom on the filter end of the cylindrical portion 82 of valve housing 80 to prevent the valve actuator paddle 90 from contacting the side wall of the cylindrical portion 82 upon the vertical movement caused by the solenoid 98.

Details of operation of the flow control valves 26 are best shown in FIG. 6. Two of the flow control valves 26 are shown positioning the actuator paddles 90 so that sealing surface 94 is offset from passageway 84 while sealing surface 96 blocks passageway 86 as illustrated at locations 110 in FIG. 6. Therefore, the control valves 26 at locations 110 of FIG. 6 permit air flow from the interior region 12 of the lower housing portion 11 of vacuum cleaner 10 through filters 28, cylindrical housings 82 and passageways 84 into the vacuum chamber 70. In FIG. 6, the control valve 26 at location 112 has been actuated so that sealing surface 94 of actuator paddle 90 blocks the passageway 84 to the vacuum chamber 70 while sealing surface 96 is spaced apart from passageway 86 coupled to aperture 54 of the pressure chamber 20. Therefore, the valve 26 at location 112 permits air flow from pressure chamber 20 through passageway 86 and into cylindrical body portion 82 of valve 26. Since the passageway 84 is blocked by sealing surface 94, air from the pressure chamber 20 passes downwardly through filter 28 as illustrated by arrow 34 in FIG. 1 to clean the filter 28. After a predetermined period of time, the valve 26 at location 112 moves the actuator paddle 90 back to a normal operating position as shown at locations 110 in FIG. 6 to seal passageway 86 and open passageway 84 so that normal suction is also applied through the cleaned filter 28 at location 112.

In the illustrated embodiment, arms 91 and 93 of actuator paddle are aligned at an angle of about 155° relative to each other. Therefore, 25° rotation of actuator paddle 90 by the solenoid 98 moves the actuator paddle 90 from a first position shown at locations 110 to a second position shown at location 112.

Figure 11:
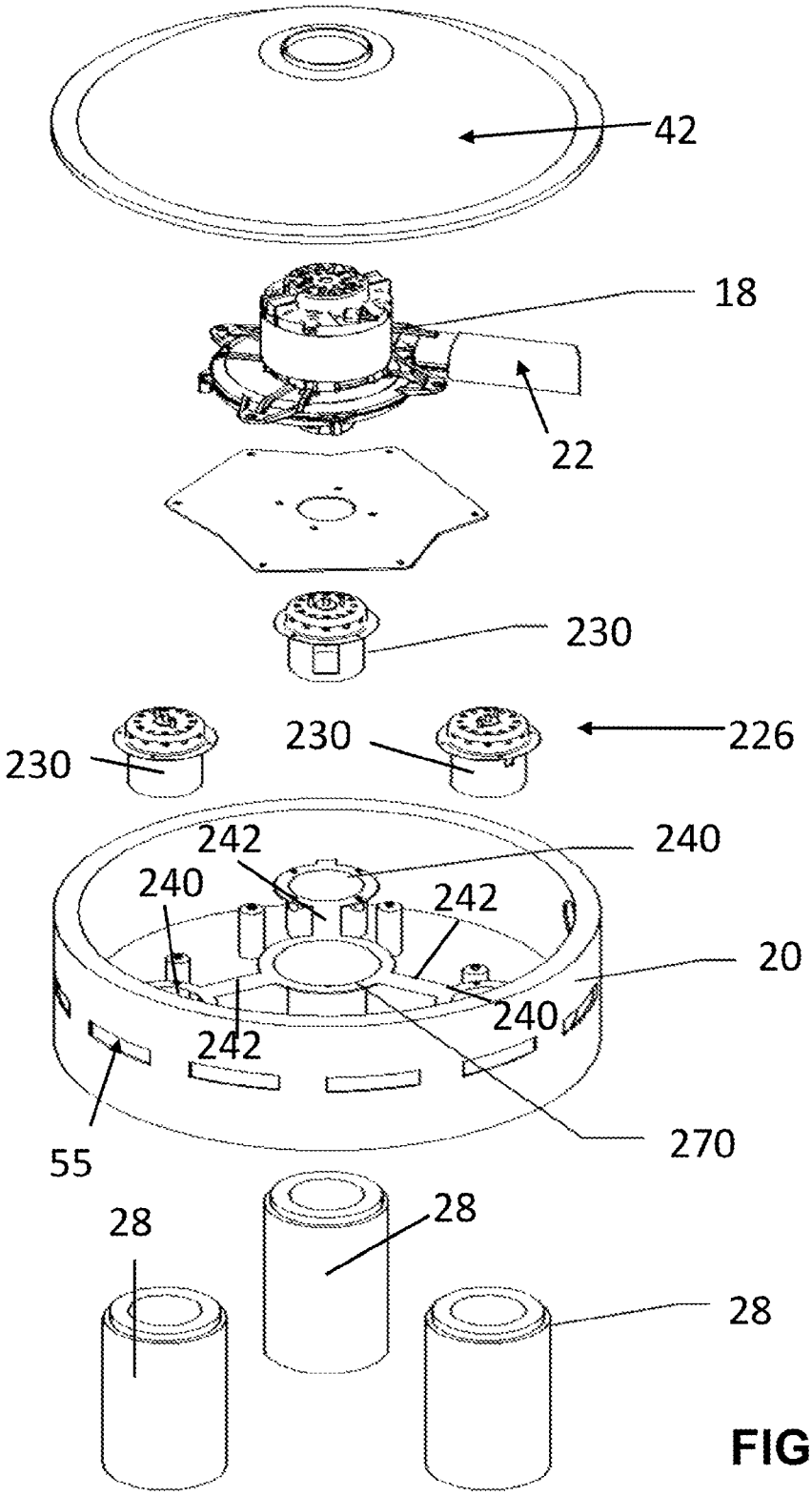
FIG. 11 is an exploded perspective view of a vacuum motor and filter system of another illustrated embodiment of the present disclosure.
Figure 12:
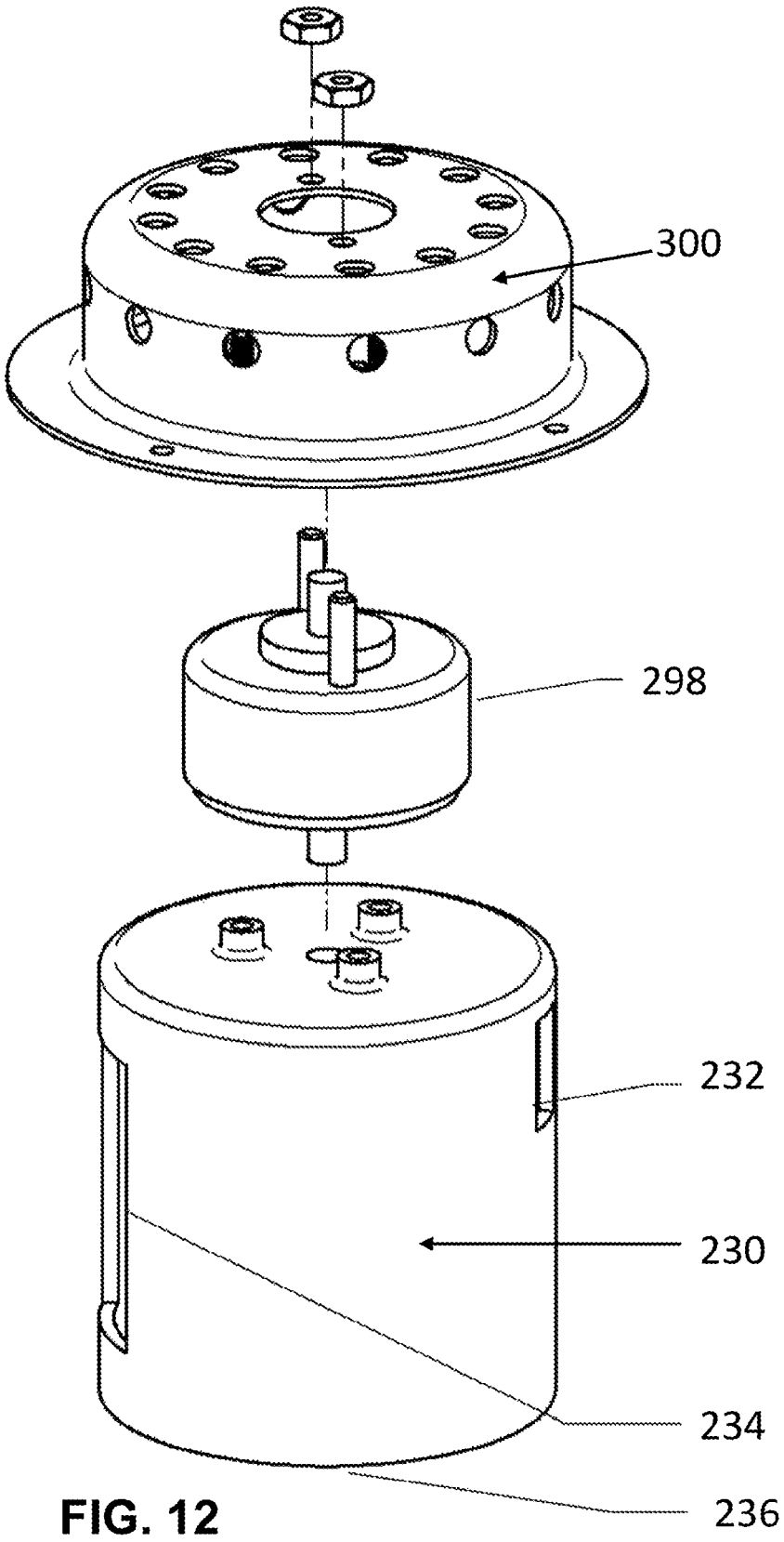
FIG. 12 is an exploded perspective view of portions of the filter system of FIG. 11.
Figure 13:
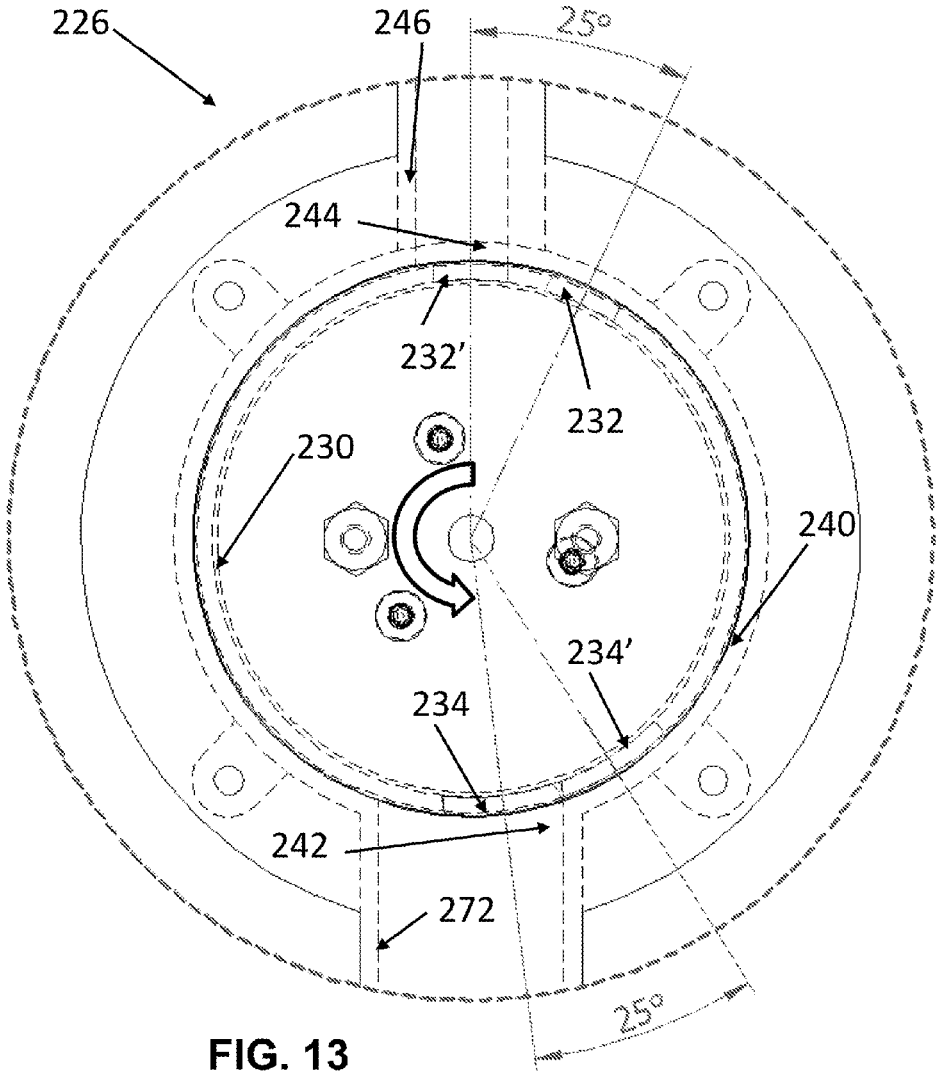
FIG. 13 is a top view of a valve assembly of FIGS. 11 and 12, with portions shown in dotted lines to illustrate movement of an inner valve cylinder relative to an outer valve cylinder.

Another embodiment of the present disclosure is shown in FIGS. 11-13. The filter system shown in FIG. 11 includes two or more filters 28. One filter 28 or divided compartment continues to provide suction while the other filter(s) 28 is (are) being cleaned. Illustratively, three filters 28 are shown in the FIG. 11 embodiment. Each filter 28 includes its own cleaning mechanism or valve 226 as shown in FIG. 11. Each valve 226 may be mechanically controlled by a rotary solenoid actuator 298 as shown in FIG. 12, manually controlled with a spring return, or controlled by a remote control. A cover 300 secures the rotary solenoid actuator 298 to the inner cylinder 230.

Each valve 226 illustratively includes an inner cylinder 230 having three separate openings. A first opening 232 is provided for connection of filter 28 to a vacuum source such as vacuum motor 18. A second opening 234 is provided for connection to a pressure cleaning chamber 20. A third opening 236 is provided for connection directly to the filter 28. The opening 236 connected directly to the filter 28 is perpendicular to the opening 234 connected to the vacuum source 18 and to the opening 232 connected to pressure cleaning chamber 20. The opening 232 connected to the pressure cleaning chamber 20 is illustratively located approximately 205 degrees CCW from the opening 234 connected to the vacuum source 18.

Each valve 226 also illustratively includes an outer cylinder 240. The outer cylinder 240 also includes three openings including one vertical opening 242 connected to the vacuum chamber 270, one vertical opening 244 connected to the pressure chamber 20 via passageway 246 and one horizontal opening connected to the filter 28. Openings 234 and 232 of inner cylinder 230 are selectively opened and closed by valve 226 rotating the inner cylinder 230 relative to the outer cylinder 240. Opening 236 is always open.

FIG. 13 is a top view of a valve assembly 226, with portions shown in dotted lines to illustrate movement of the inner valve cylinder 230 relative to the outer valve cylinder 240. The inner cylinder 230 rotates approximately 20-25 degrees in the direction of the arrow in FIG. 13 and connects the pressure port 20 to the filter 28 by aligning the vertical opening or pressure port 232 of the inner cylinder 230 with the outer pressure port connection or opening 244 in the outer cylinder 240 as best shown in the position 232' of FIG. 13. The vacuum source is "disconnected" simultaneously by moving the opening or vacuum port 234 of the inner cylinder 230 out of alignment with vacuum port formed in outer cylinder 240 as best shown by the position 234'.

Vacuum 270 is connected to the outer valve cylinders 240 and the plurality of filters 28 by passageways 272 aligned with a vacuum port 234 formed in the outer cylinder 240. The vacuum motor 18 is either service mounted on top of the chamber 270 or connected via hosing in order to provide suction to the chamber 270. The motor 18 is illustratively a tangential bypass motor with an exhaust horn when service mounted.

A pressure chamber 20 surrounds the entire mechanism and receives the exhaust air from the blower or exhaust of vacuum motor 18. This exhaust air is available to rush through each valve 226 when the valve 226 is activated and the pressure port 232 of inner cylinder 230 aligns with the pressure port of outer cylinder 240. This pressure chamber 20 provides a burst of air in reverse through the activated valve 226 and cleans the filter 28. The mechanism and plurality of filter valves 226 may be controlled automatically with a timed electronic system or manually controlled at will.

The reverse pressure action is very quick so to not allow too much pressured air into the vacuum chamber 270. The valve 226 then springs back to return to its neutral position with the opening 234 of inner cylinder 230 aligned with the vacuum port of outer cylinder 240 so that a vacuum is again pulled through the filter 28. In the "vacuum" position, pressure opening 232 of inner cylinder 230 is not aligned with the pressure port of the outer cylinder 240 as shown by positions 234 and 232 in FIG. 13.

As discussed above, one of the valves 226 can be activated to clean an associated filter 28 while suction is maintained through the other filters 28. This permits continuous operation of the vacuum.

While this disclosure has been described as having exemplary designs and embodiments, the present invention may be further modified within the spirit and scope of this disclosure. This application is therefore intended to cover any variations, uses, or adaptations of the disclosure using its general principles. Further, this application is intended to cover such departures from the present disclosure as come within known or customary practice in the art to which this disclosure pertains.

The invention claimed is:

1. A vacuum cleaner system comprising:

a housing having an interior region, an inlet opening, and at least one outlet opening;

a vacuum motor having an exhaust;

a pressure chamber coupled to the exhaust of the vacuum motor;

at least one filter located in the interior region of the housing in communication with the at least one outlet opening of the housing; and at least one air flow control valve, each valve being coupled to the vacuum motor, the pressure chamber and a filter, the at least one valve being operable to couple the at least one filter to the vacuum source to provide suction therethrough when the at least one valve is in a first position, and alternately to couple the at least one filter to the pressure chamber when the at least one valve is in a second position to supply pressurized air from the pressure chamber to the at least one filter to clean the at least one filter.

2. The system of claim 1, further comprising an upper housing portion having an outer wall and a spaced apart inner wall configured to define the pressure chamber therebetween, the exhaust of the vacuum motor being coupled to an inlet formed in the inner wall to pressurize the pressure chamber.

3. The system of claim 2, wherein the outer wall includes at least one opening therein to permit a controlled amount of pressurized air from the exhaust of the vacuum motor to escape from the pressure chamber.

4. The system of claim 3, wherein the inner wall further includes an aperture in fluid communication with an inlet of the at least one valve to provide fluid communication between the at least one valve and the pressure chamber.

5. The system of claim 2, wherein the inner and outer walls are annular shaped walls to define an interior region of the upper housing portion, the vacuum motor and the at least one valve being located within the interior region of the upper housing portion, and wherein the at least one outlet opening of the housing is formed in a bottom surface of the upper housing portion.

6. The system of claim 5, wherein the at least one filter is coupled to the bottom surface of the upper portion housing in communication with the outlet opening.

7. The system of claim 1, further comprising a vacuum chamber coupled to the vacuum motor, the vacuum chamber having an aperture formed therein in communication with the at least one valve.

8. The system of claim 7, wherein at least one valve includes a valve housing having a cylindrically shaped body portion and first and second passageways extending away from the body portion, the first passageway being coupled to the pressure chamber and the second passageway being coupled to the vacuum chamber, the at least one valve also including an actuator paddle located in the cylindrically shaped body portion, the actuator paddle including first and second sealing surfaces configured to selectively open and close the first and second passageways, respectively, upon rotation of the actuator paddle relative to the valve housing.

9. The system of claim 8, wherein at least one valve further includes an electrical actuator coupled to the actuator paddle, the electrical actuator being operable to move the actuator paddle from a first position in which the first sealing surface blocks the first passageway and the second sealing surface is spaced apart from the second passageway to provide communication between the vacuum chamber and the filter coupled to the at least one valve to a second position in which the second sealing surface blocks the second passageway and the first sealing surface is spaced apart from the first passageway to permit air flow from the pressure chamber to the filter through the at least one valve.

10. The system of claim 9, wherein the valve housing has a lower edge and the first and second sealing portions of the actuator paddle extend below the lower edge of the valve housing to maintain sealing between the first and second sealing members and the first and second passageways of the valve housing upon vertical movement of the electrical actuator and the actuator paddle which occurs as the electrical actuator moves the actuator paddle between the first and second positions.

11. The system of claim 9, wherein the actuator paddle moves from the first position to the second position in response to about a 25° rotation of the actuator paddle by the electrical actuator.

12. The system of claim 11, wherein the electrical actuator is a rotary solenoid actuator.

13. The system of claim 9, wherein the first sealing surface of the actuator paddle is coupled to a first arm and the second sealing surface is coupled to a second arm, the first and second arms forming an angle of about 155 degrees relative to each other.

14. The system of claim 9, further comprising a wireless remote control configured to selectively activate the electrical actuator to move the actuator paddle from the first position to the second position.

15. The system of claim 8, wherein at least one valve further includes a manual actuator coupled to the actuator paddle, the manual actuator being operable to move the actuator paddle from a first position in which the first sealing surface blocks the first passageway and the second sealing surface is spaced apart from the second passageway to provide communication between the vacuum chamber and the filter coupled to the at least one valve to a second position in which the second sealing surface blocks the second passageway and the first sealing surface is spaced apart from the first passageway to permit air flow from the pressure chamber to the filter through the at least one valve.

16. The system of claim 15, wherein at least one valve further includes a spring configured to return the actuator paddle back to the first position from the second position.

* * * * *